US007451558B2

(12) United States Patent
Jones

(10) Patent No.: US 7,451,558 B2
(45) Date of Patent: Nov. 18, 2008

(54) WEAR ASSEMBLY FOR EXCAVATING DIGGING EDGE

(75) Inventor: Larren F. Jones, Portland, OR (US)

(73) Assignee: ESCO Corporation, Portland, OR (US)

( * ) Notice: Subject to any disclaimer, the term of this patent is extended or adjusted under 35 U.S.C. 154(b) by 482 days.

(21) Appl. No.: 11/216,697

(22) Filed: Aug. 31, 2005

(65) Prior Publication Data

US 2005/0284006 A1 Dec. 29, 2005

Related U.S. Application Data

(63) Continuation of application No. 10/425,605, filed on Apr. 30, 2003, now Pat. No. 7,080,470.

(51) Int. Cl.
*E02F 9/28* (2006.01)

(52) U.S. Cl. ..... 37/452; 37/456; 403/378

(58) Field of Classification Search ..... 37/446, 37/447, 449–459; 172/772, 772.5, 753, 713; 403/378, 379

See application file for complete search history.

(56) References Cited

U.S. PATENT DOCUMENTS

| | | | | |
|---|---|---|---|---|
| 1,031,138 | A | 7/1912 | McKee et al. | |
| 1,076,548 | A | 10/1913 | Butler | |
| 1,485,243 | A | 2/1924 | Blake | |
| 1,775,984 | A | 9/1930 | Younie | |
| 1,959,847 | A | 5/1934 | Buskirk | |
| 2,113,420 | A * | 4/1938 | Younie | 37/456 |
| 3,160,967 | A | 12/1964 | Nichols | |
| 3,456,370 | A * | 7/1969 | Gilbertson | 172/701.2 |
| 3,685,177 | A * | 8/1972 | Hahn et al. | 37/446 |
| 3,736,664 | A * | 6/1973 | Black et al. | 37/446 |
| 3,841,007 | A | 10/1974 | Howarth et al. | |
| 3,851,413 | A | 12/1974 | Lukavich | |
| 3,864,853 | A | 2/1975 | Klett et al. | |
| 3,947,982 | A | 4/1976 | Mantovani | |
| 3,974,579 | A | 8/1976 | Black et al. | |
| 3,995,384 | A | 12/1976 | Wood | |

(Continued)

FOREIGN PATENT DOCUMENTS

| | | |
|---|---|---|
| WO | WO 02/12642 | 2/2002 |

OTHER PUBLICATIONS

ESCO Brochure; "Instructions for T4-V71, T4L-V71, & T4R-V71 Toplik@Adapters", M/LMS-504-0302, 2002, pp. 1-8.

(Continued)

*Primary Examiner*—Thomas A Beach
(74) *Attorney, Agent, or Firm*—Steven P. Schad

(57) ABSTRACT

A wear assembly that includes a wear member and a boss to define an opening for receiving a lock forward of the front edge face of the lip which can mount the wear member in a stable and balanced manner without a through-hole in the lip. The wear member includes an aperture and a rib to define bearing faces on opposite sides of a central plane of the lip. The boss includes rails to hold the wear member in place, and a brace at the rear end, which supports the rails on the boss, abuts the rear of the wear member to reduce the loading on the lip, and deflects earthen material away from the wear member under reverse loading.

16 Claims, 14 Drawing Sheets

U.S. PATENT DOCUMENTS

| | | | | | |
|---|---|---|---|---|---|
| 4,006,544 | A | | 2/1977 | Stepe | |
| D245,780 | S | | 9/1977 | Dahlberg et al. | |
| 4,074,449 | A | * | 2/1978 | Lanz et al. | 228/114 |
| 4,103,442 | A | | 8/1978 | Zepf | |
| 4,205,469 | A | | 6/1980 | Johansson et al. | |
| 4,449,309 | A | | 5/1984 | Hemphill | |
| 4,457,380 | A | | 7/1984 | Curry | |
| 4,501,079 | A | | 2/1985 | Hahn et al. | |
| 4,570,365 | A | | 2/1986 | Bierwith | |
| 4,716,667 | A | | 1/1988 | Martin | |
| 4,748,754 | A | | 6/1988 | Schwappach | |
| 5,005,304 | A | | 4/1991 | Briscoe et al. | |
| 5,016,365 | A | | 5/1991 | Robinson | |
| 5,052,134 | A | | 10/1991 | Bierwith | |
| 5,063,695 | A | | 11/1991 | Briscoe et al. | |
| 5,075,986 | A | | 12/1991 | Smith et al. | |
| 5,088,214 | A | | 2/1992 | Jones | |
| 5,241,765 | A | | 9/1993 | Jones et al. | |
| 5,283,965 | A | | 2/1994 | Clendenning | |
| 5,396,964 | A | | 3/1995 | Shellhorn et al. | |
| 5,412,885 | A | * | 5/1995 | Cornelius | 37/451 |
| 5,438,774 | A | | 8/1995 | Fletcher et al. | |
| 5,465,512 | A | | 11/1995 | Livesay et al. | |
| 5,553,409 | A | | 9/1996 | Irving | |
| 5,564,508 | A | | 10/1996 | Renski | |
| 5,634,285 | A | | 6/1997 | Renski | |
| 5,653,048 | A | | 8/1997 | Jones et al. | |
| 5,713,145 | A | | 2/1998 | Ruvang | |
| 5,806,216 | A | | 9/1998 | Renski | |
| 5,852,888 | A | | 12/1998 | Cornelius | |
| 5,937,549 | A | | 8/1999 | Bender et al. | |
| 5,992,063 | A | | 11/1999 | Mack | |
| 6,047,487 | A | | 4/2000 | Clendenning | |
| 6,145,224 | A | | 11/2000 | Stickling | |
| 6,151,812 | A | | 11/2000 | Bierwith | |
| 6,194,080 | B1 | | 2/2001 | Stickling | |
| 6,209,238 | B1 | | 4/2001 | Ruvang | |
| 6,393,739 | B1 | | 5/2002 | Shambling et al. | |
| 6,729,052 | B2 | | 5/2004 | Ollinger et al. | |

OTHER PUBLICATIONS

ESCO Booklet; ESCO Toplok Adapter System For Plate Lips, Mining College '97, DMC Sep. 9, 1997, Illustrations 1-23.

Clark Equipment, Bucket Tooth Adapter Installation Drawing, No. 1545546, Mar. 13, 1970.

* cited by examiner

WEAR ASSEMBLY FOR EXCAVATING DIGGING EDGE

This application is a continuation of U.S. patent application Ser. No. 10/425,605 filed Apr. 30, 2003, now U.S. Pat. No. 7,080,470.

FIELD OF THE INVENTION

The present invention pertains to a wear assembly for protecting the front edge of a structure subjected to wear, and is particularly suited for use along the front digging edge of an excavating bucket or the like.

BACKGROUND OF THE INVENTION

Excavating buckets and other excavating equipment are typically subjected to harsh conditions. A series of wear members are usually provided to protect the digging edges from premature wear. Wear members have been secured to the digging edge in many different ways.

For example, in U.S. Pat. No. 4,570,365 to Bierwith, the wear members are secured to the lip of the bucket by the use of a wedge and spool lock arrangement that is fit through a hole in the lip spaced from the front edge. In this arrangement, the spool pinches the rear parts of the wear member against the inner and outer faces of the lip as the wedge is driven into the hole. However, under load, the legs of the wear member can shift and cause loosening of the lock and possible loss of the wear member. In addition, the formation of a hole in the lip weakens the lip and its ability to effectively resist the large loads applied as the lip is forced into the ground.

In U.S. Pat. No. 3,995,384 to Wood and U.S. Pat. No. 4,748,754 to Schwappach, the hole in the lip is eliminated and replaced with a lateral boss that is welded to the inner face of the lip generally parallel to the front edge. While these constructions avoid weakening the lip with a through-hole, they place very large loads on the lateral boss, and thus, can only be reliably used in low stress environments.

In U.S. Pat. No. 5,088,214, the wear member is secured by a boss that is welded to the inner face of the lip so as to extend generally normal to the front edge. The wear member, then, is slipped over the boss via a complementary slot. As can be appreciated, this orientation of the boss greatly reduces the loads on the boss as compared to the lateral bosses. Nevertheless, the wear member is typically secured by a single lock located to one side of the lip. While this is adequate for most applications, this arrangement does orient the lock in an off-center relationship relative to the lip and thus engenders increased vertically oriented stresses on the legs of the wear member as well as the lip. Greater balance in resisting the loads applied to the wear member can be achieved by utilizing a boss and lock for the inner and outer legs (see, e.g., FIG. 5 of the '214 patent). However, this construction requires more steel and twice as many bosses and locks for the attachment of each wear member.

As a result, there is a need for an improved assembly for attaching a wear member to the digging edge of an excavator that avoids the problems of the prior art.

SUMMARY OF THE INVENTION

In accordance with one aspect of the invention, the wear member is secured to the lip of an excavator (e.g., an excavating bucket) in a stable and balanced manner without the formation of a through-hole in the lip. In a preferred construction, the wear assembly includes a boss and a wear member that cooperate to define a passage forward of the front edge face of the lip for receiving the lock. In this way, the lock can be engaged on each side of the central plane of the lip. The lip can be maintained as an imperforate member for greater strength and durability.

In another aspect of the present invention, the lip of the excavator includes an inner face, an outer face and a front edge face. The front edge face includes a plurality of spaced scallops. The scallops cooperate with the wear assembly to permit a through-hole for the lock to be formed forward of the lip without undue forward projection of the boss. The scallops are preferably formed by a concave wall that extends no more than about 180 degrees about an axis that is generally perpendicular to the lip. In this way, the scallop can provide the desired space for the lock without causing significant weakening of the lip.

In one other aspect of the invention, the wear member includes a pair of spaced bearing surfaces to contact the lock generally on opposite sides of the central plane of the lip. In a preferred construction, the wear member is bifurcated to define a pair of rearward legs. One of the legs includes an aperture into which the lock is received. A bearing surface associated with the aperture engages the lock on one side of the central plane of the lip to hold the wear member in place. The other leg includes a rib that extends toward the aperture. The rib includes a bearing surface to engage the lock on an opposite side of the central plane of the lip.

In another aspect of the invention, a boss includes a front part that extends along the front edge face of the lip and a body that extends along the inner or outer face of the lip. The body defines a hole forward of the front edge face of the lip to receive the lock for securing the wear member in place. In the preferred construction, the front part wraps around the lip to define a finger portion that opposes the body. The front part defines an opening that is aligned with the hole in the body to define a passage into which the lock is inserted.

In another aspect of the invention, the boss includes a body that extends along one of the faces of the lip. Rails extend along opposite sides of the boss to cooperate with a complementary structure on the wear member to hold the wear member in place. A brace extends laterally beyond at least part of the body and is fixed to the rails to provide enhanced support to the rails.

In one other aspect of the invention, the boss includes a body that extends along one of the faces of the lip and a brace at a rear end of the body. The brace extends beyond the body in a transverse direction to define a front bearing face against which a rear wall of the wear member can abut. In this way, the applied forces and stresses on the lip can be reduced to thereby lessen the maintenance requirements and lengthen the usable life of the lip.

In another aspect of the invention, the boss is formed with a raised deflector that tends to deflect earthen material away from the wear member when the excavator is reversed. In the preferred construction, the deflector is formed at the rear end of and extends farther from the lip than the forward portions of the boss to be juxtaposed to the rear wall of the wear member. An inclined deflector face is preferably formed to reduce the forces applied to the deflector under reverse loading.

DETAILED DESCRIPTION OF THE PRESENT INVENTION

In accordance with the present invention, a wear assembly 10 is provided for attachment along the digging edge of a lip of an excavator. The invention is discussed below in terms of the attachment of a shroud to the lip of a load-haul-dump (LHD) bucket. However, the invention is not limited to the attachment of a shroud or an LHD bucket. The invention could be used to secure other wear members to other excavators, and even to other equipment where the edge is subject to heavy loading and wear as in an excavating environment.

The invention is at times discussed in terms of relative terms, such as up, down, right, left, vertical, horizontal, etc. for the sake of easing the description. These terms are to be considered relative to the orientation of the elements in FIG. 1 (unless otherwise noted), and are not to be considered limitations on the invention. As can be appreciated, the wear member can be used and oriented in a variety of ways.

Figure 2:
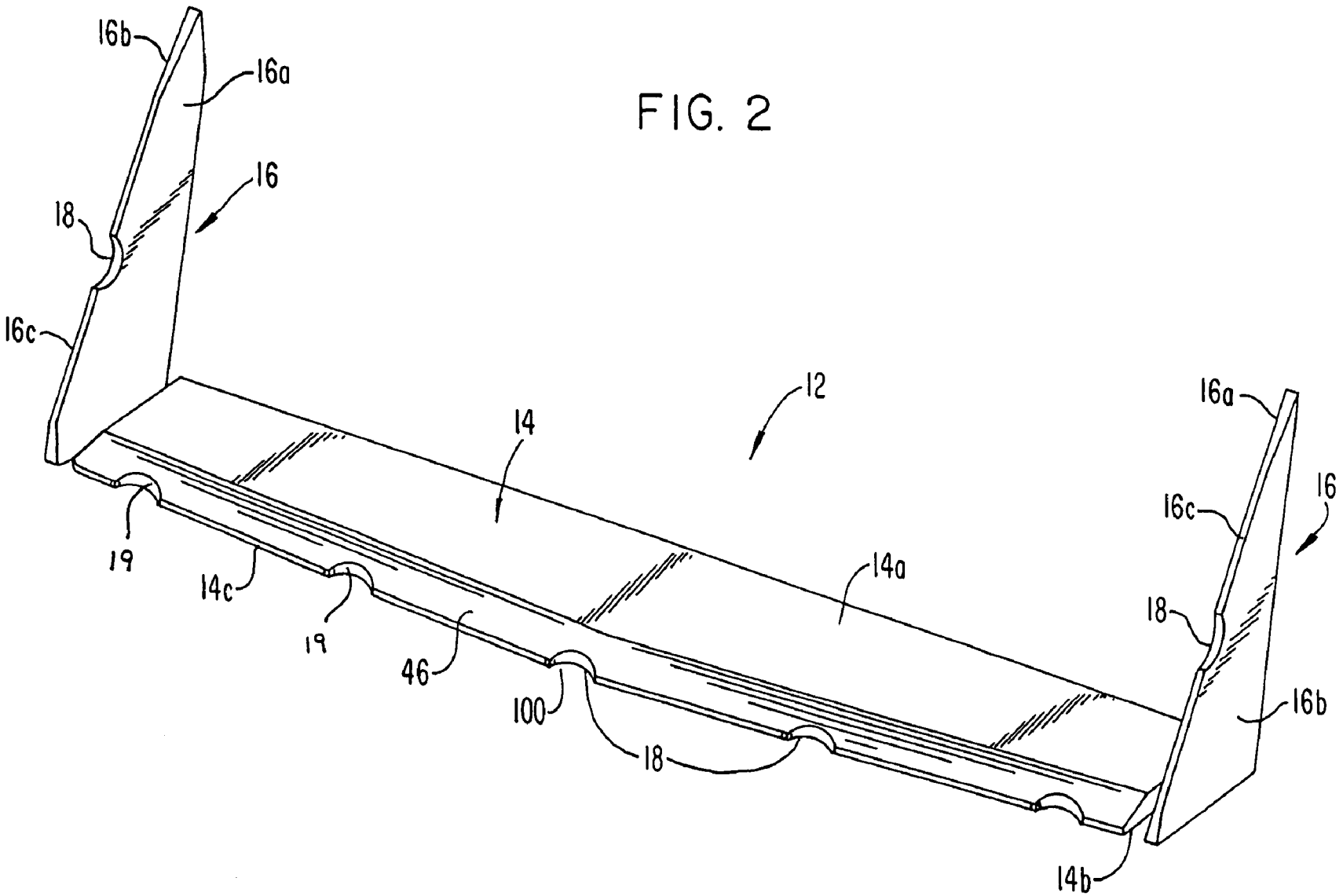
FIG. 2 is a perspective view of the lip in accordance of the present invention.

Lip 12 forms the front digging edge of an LHD bucket (not shown) to engage and penetrate into the ground for the gathering of earthen material. As seen in FIG. 2, lip 12 includes a center section or main member 14 that extends horizontally across the front of the bucket and a pair of corner sections 16 generally at right angles to the center section. Corner sections 16 form the lower ends of the front edges of the bucket sidewalls. Each of the lip sections includes an inner face 14*a*, 16*a*, an outer face 14*b*, 16*b*, and a front edge 14*c*, 16*c*. No through-holes are formed in the lip sections. Hence, the lip is able to provide a strong base to amply resist the high forces applied during use.

The front edges 14*c*, 16*c* of lip sections 14, 16 are defined with spaced scallops or recesses 18, one for each wear assembly 10. In the illustrated example, five uniformly spaced scallops are formed along front edge 14*c*, and one scallop in each of front edges 16*c*. The scallops are each preferably formed to have a uniform, continual, arcuate surface 19 with a curvature that extends no more than about 180 degrees about an axis extending generally perpendicular to the lip, and preferably is at about 180 degrees. In this way, lip 12 with scallops 18 can be easily manufactured, provide a robust base to resist the applied loads, and (as discussed below) provide clearance for the lock of wear assembly 10 during use. Nevertheless, the scallops could be formed to have a non-uniform curvature, a discontinuous or angular shape, and/or be formed to have partial closure (i.e., a surface with more than a 180 degree extension such that certain side portions of the scallop are opposed to each other). Each of these variations, though, tends to increase the cost of manufacture, lead to more significant stress concentrations, and/or reduced strength.

Figure 6:
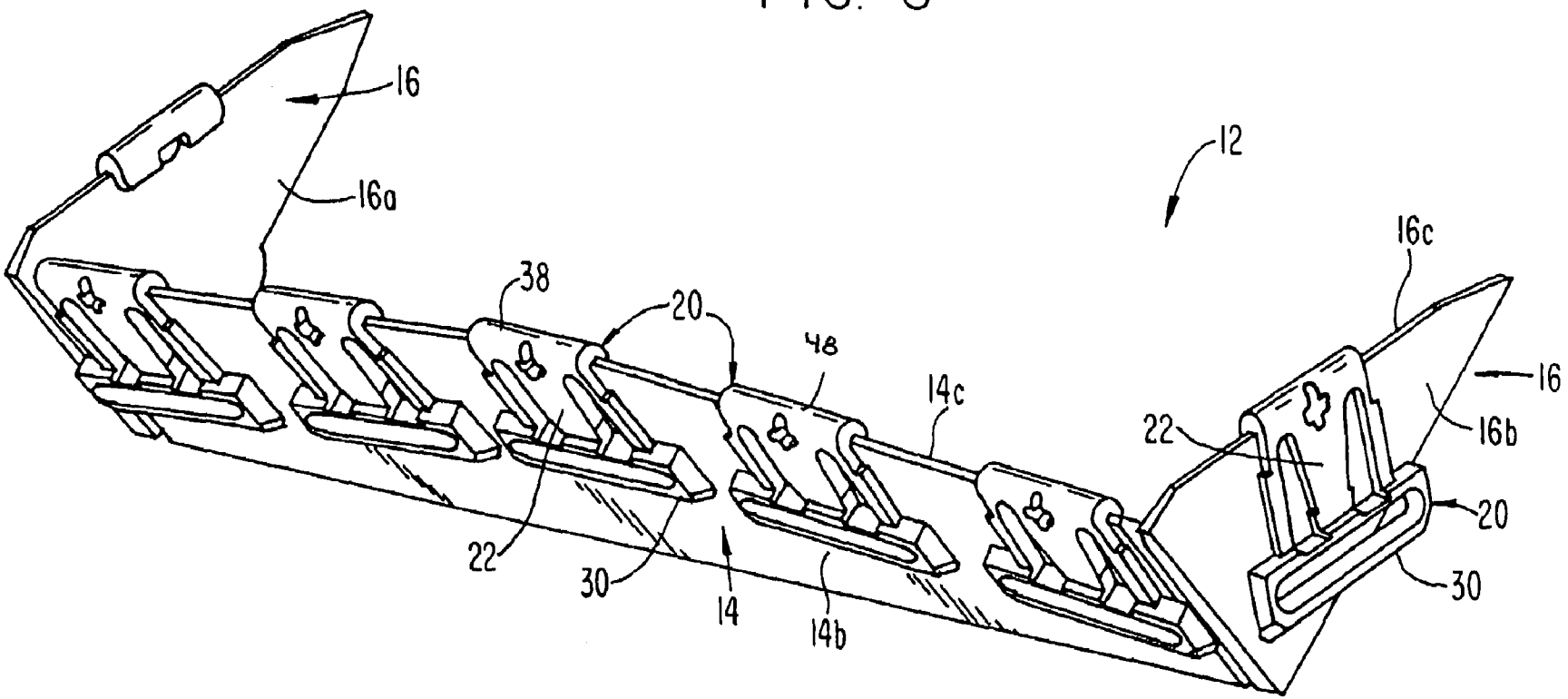
FIG. 6 is a perspective view of a series of the bosses attached to the lip.

As shown in FIG. 6, a boss 20 is fixed to lip 12 over each scallop 18. While bosses 20 are preferably welded to the lip, they could be cast as an integral part of the lip or secured by mechanical means. In addition, the bosses could each be formed as a multiple of parts, which are integral or spaced apart, although a one-piece member is preferred for simplicity and strength.

Figure 3:
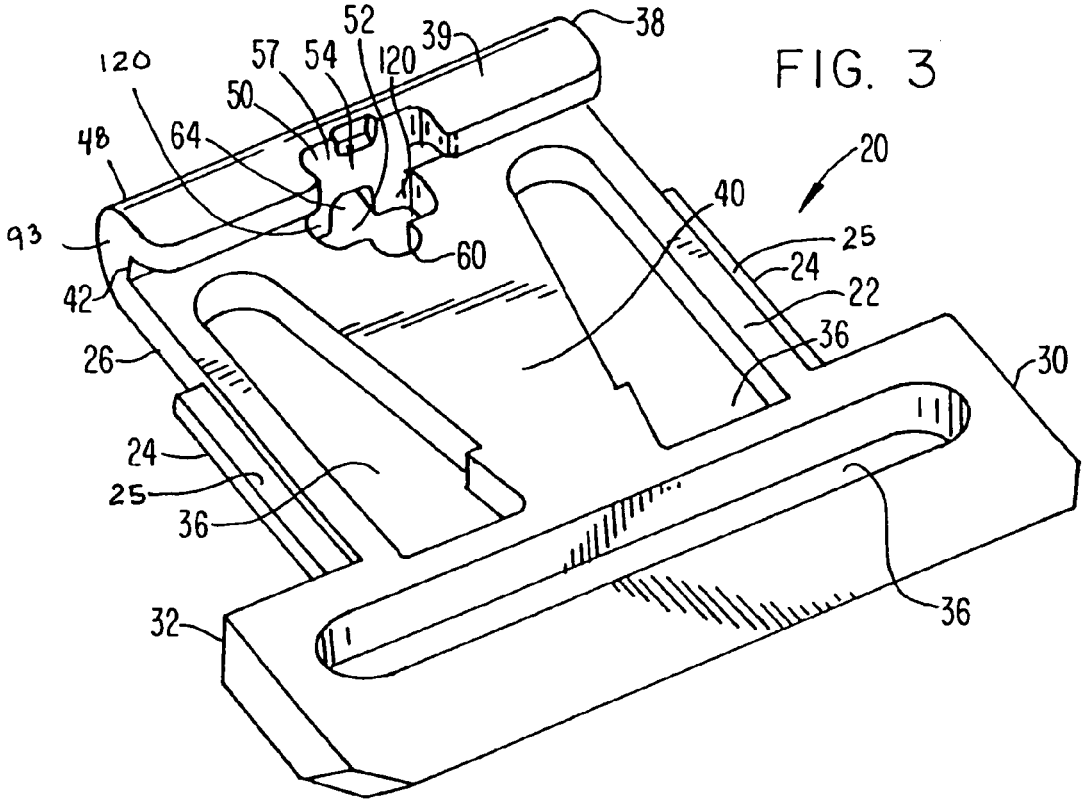
FIG. 3 is top perspective view of a boss in accordance with the present invention.
Figure 4:
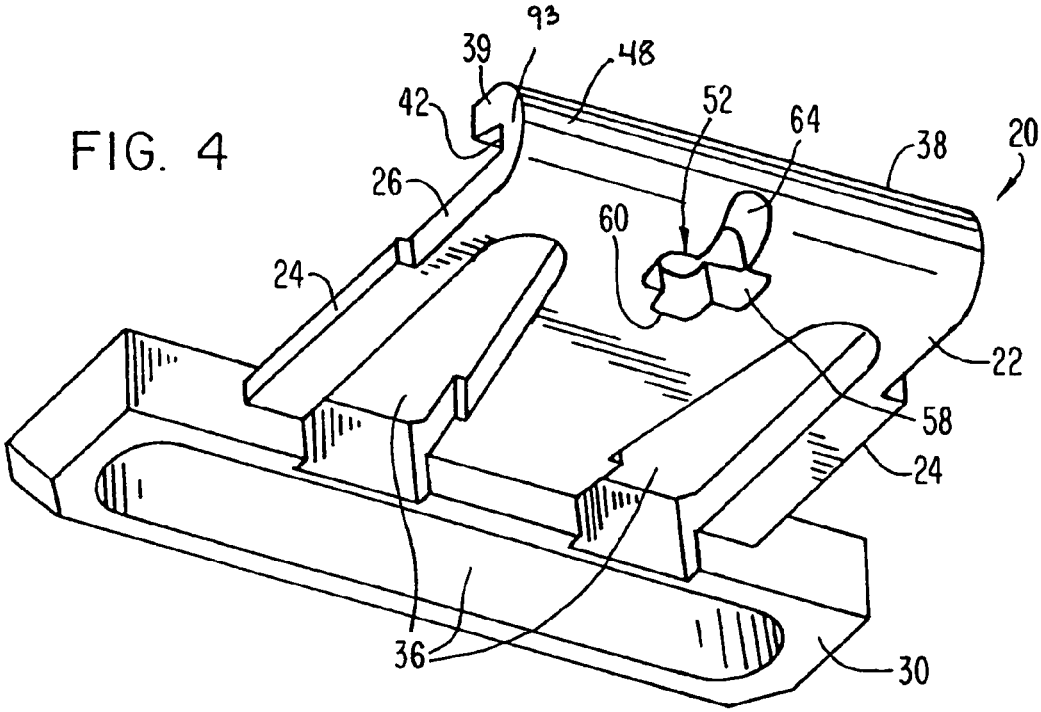
FIG. 4 is a bottom perspective view of the boss.
Figure 5:
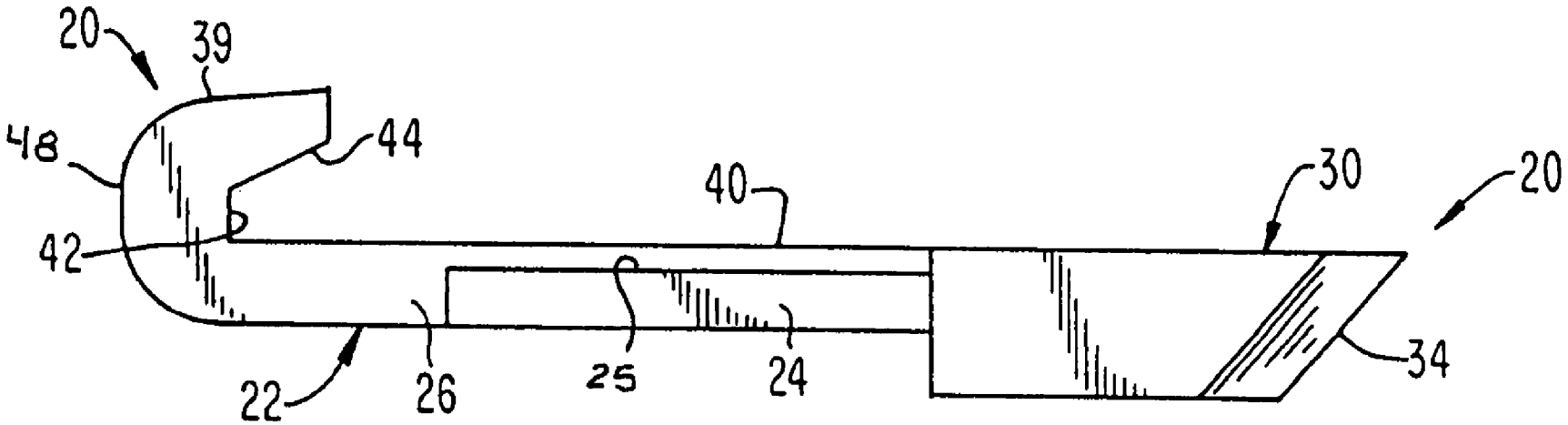
FIG. 5 is a side view of the boss.

Boss 20 has a body 22 extending along outer face 14*b* of lip 12 (FIGS. 3-5). Body 22 preferably includes a pair of rails 24 extending along sidewalls 26 in a rearward direction from front edge 14*c*, 16*c*. The rails project laterally outward from each sidewall 26 to form a T-shaped configuration. Rails 24 have holding surfaces 25 that are spaced from and facing outer face 14*b*, 16*b*. As discussed below, rails 24 cooperate with wear member or (in this case) shroud 28 to prevent its movement away from the lip. While a T-shaped configuration is preferred, the rails could have other shapes, such as dovetail. Moreover, for lower stress environments, the rails could be omitted entirely (not shown) so that only the sidewalls 26 defined the sides of the body.

A brace 30 extends laterally across the rear end of body 22. In the preferred construction, the rear ends of rails 24 are integrally fixed to a brace 30 to additionally support the rails when under load. Brace 30 further extends outward beyond the rails to define a stop surface 32 adapted to abut the rear end of shroud 28 and thereby reduce the stress on the boss, which in turn, reduces the stress along front edge 14*c*, 16*c* of lip 12. The use of a brace as an abutment and/or to support the rails has applicability in other arrangements for mounting wear members, such as disclosed in U.S. patent application Ser. No. 11/216,544, filed concurrently herewith and entitled "Wear Assembly for the Digging Edge of an Excavator" which is in its entirety hereby incorporated by reference.

Brace 30 also preferably has a greater depth than body 22 so that it extends from the lip a greater distance than the body to maximize the surface area able to abut the shroud and to function as a deflector for earthen material when the bucket is reversed to reduce reverse loading of shroud 28. A deflector face 34 inclined forward from outer face 14*b*, 16*b* is preferably formed along the rear side of brace 30 to direct the earthen material away from the assembled boss and shroud. Body 22 and brace 30 are formed as an open framework, with openings 36 to reduce the amount of needed steel and to facilitate welding of the boss to the lip.

A front part 38 of boss 20 wraps around front edge 14*c*, 16*c* of lip 12 to define a finger portion 39 along inner face 14*a*, 16*a*. Inner surface 40 of boss 20 (i.e., the surface that faces lip 12) is shaped to conform to the shape of the particular lip to which it is fixed. In this case, the inner face includes an upright face 42 to set against front edge 14*c*, 16*c* and an upper face 44 to set against ramp 46 of inner face 14*a*. In the preferred construction, the bosses attached to corner sections 16 are the same as those attached to center section 14. However, other attachments are possible. If the front of the lip had a curved or other shape, inner surface 40 would be changed to match the shape of the lip. The front face 48 of boss 20 preferably has a uniform curved shape, but other shapes are possible. Alternatively, front part 38 could be formed to simply be upturned to abut against front edge 14*c*, 16*c* and not overlie inner face 14*a*, 16*a*. Also, front part 38 could be entirely omitted so that boss 20 only lies along outer face 14*b*, 16*b*. In addition, body 22 could be fixed to inner face 14*a*, 16*a* instead of outer face 14*b*, 16*b* if desired.

Figure 7:
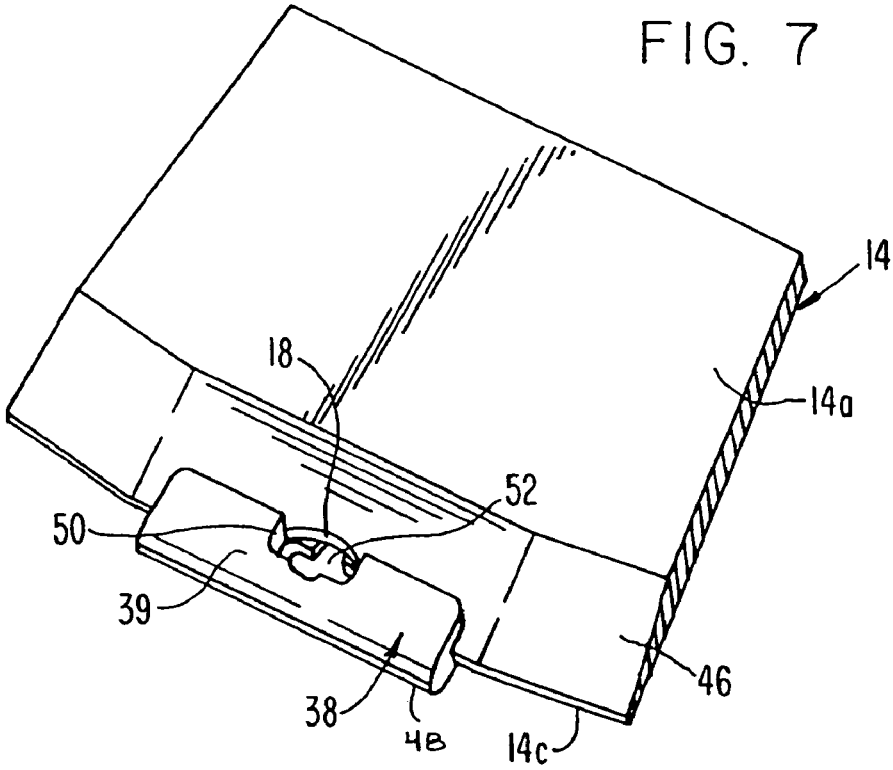
FIG. 7 is an enlarged top perspective view of one of the bosses attached to the lip.
Figure 8:
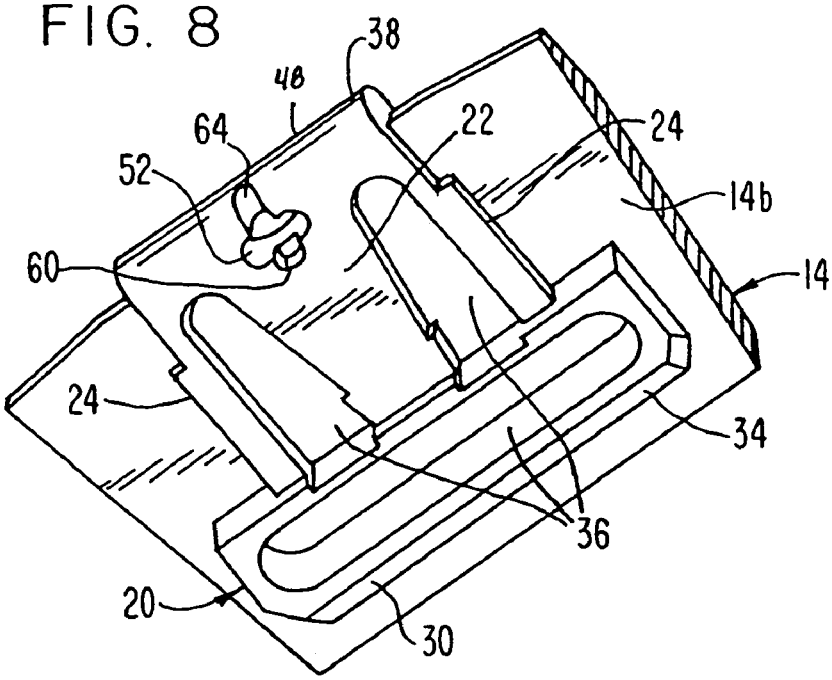
FIG. 8 is an enlarged bottom perspective view of one of the bosses attached to the lip.

A recess 50 is formed in finger portion 39. A hole 52 in body 22 is aligned with recess 60 to collectively define a passage 54 for receiving a lock 56. In the preferred construction, recess 50 has a generally U-shaped configuration; though other shapes are possible. The main wall 57 of recess 50 is preferably aligned with upright face 42 for bearing against the lock . Hole 52 has a main portion 58 that preferably has a laterally elongated, generally rectangular shape; though other shapes are possible. The shapes of recess 50 and hole 52 are largely dependent on the shape of the lock. While hole 52 preferably extends through body 22, it could have a closed lower end (which would result in the elimination of rib 62). A pocket 60 is defined along a medial section of main portion 58 to receive a rib 62 of shroud 28. A groove 64 is formed in front face 48 and through front part 38 to connect with main portion 58 of hole 52. Groove 64 is provided to permit the passage of rib 62 to pocket 60 and is thus aligned with pocket 60. Boss 20 is fixed to lip 12 such that recess 50 and hole 52 are centrally aligned with one of the scallops 18 (FIGS. 7 and 8).

In the preferred construction, shrouds 28 have a front working portion 66 that tapers to a narrowed front edge 68, and a rear mounting portion 70 that is bifurcated to define an inner leg 72 and an outer leg 74 (FIGS. 13-18). Outer leg 74 has a generally flat outer face 76 and a rear deflector face 78 that is inclined forwardly away from lip 12 to direct any earthen material away from the wear member during reverse movement of the bucket. The inner face 80 preferably has a pair of dogleg flanges 82 that face inward to define a T-shaped slot 84 for receiving body 22 and rails 24. Flanges 82 could vary in shape to define slot with a dovetail or other configurations which complement the shape of rails 24, or to simply be upright when no rails are provided. Alternatively, the flanges could be replaced with a thicker outer leg that includes inner walls to form the slot receiving the boss 20. Also, the tongue and groove arrangement could be reversed so that the boss was formed to define the slot and the wear member the tongue received into the slot (not shown).

Figure 13:
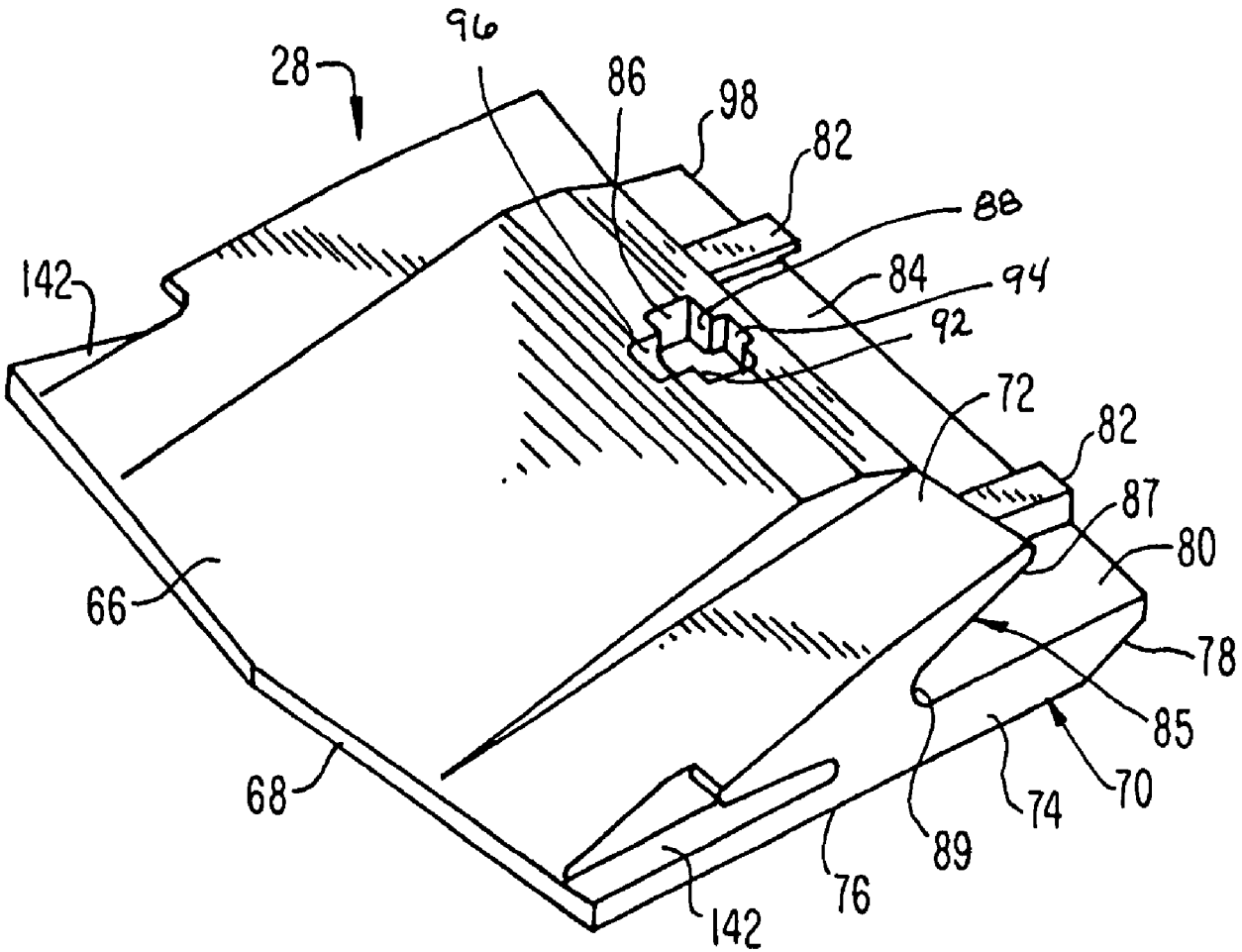
FIG. 13 is a top perspective view of a wear member in accordance with the present invention.
Figure 14:
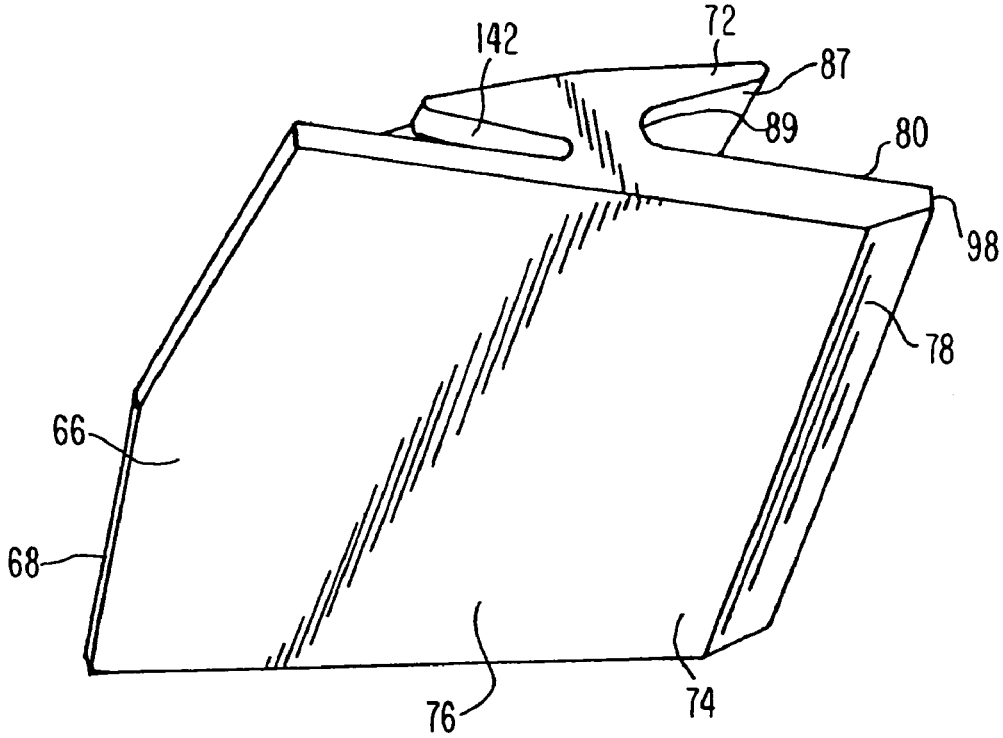
FIG. 14 is a bottom perspective view of the wear member.
Figure 15:
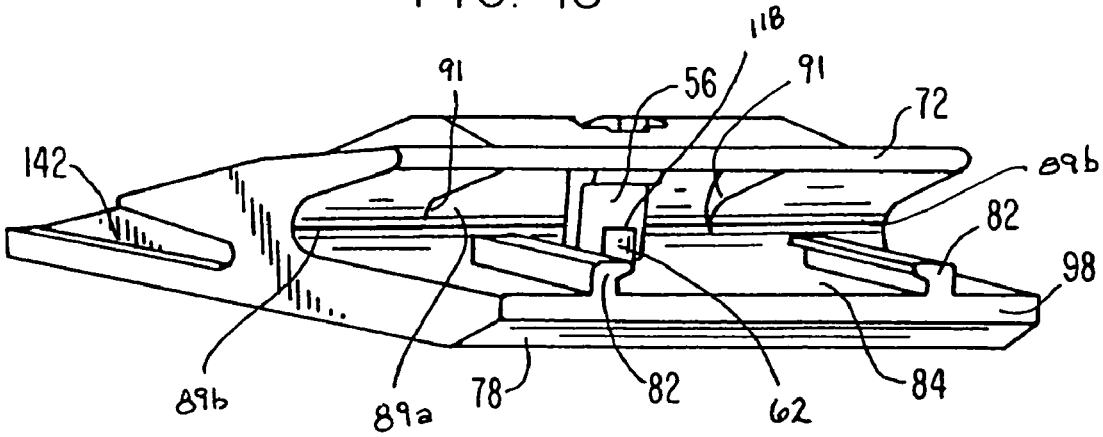
FIG. 15 is a rear view of the wear member and its relation to the lock during use.
Figure 16:
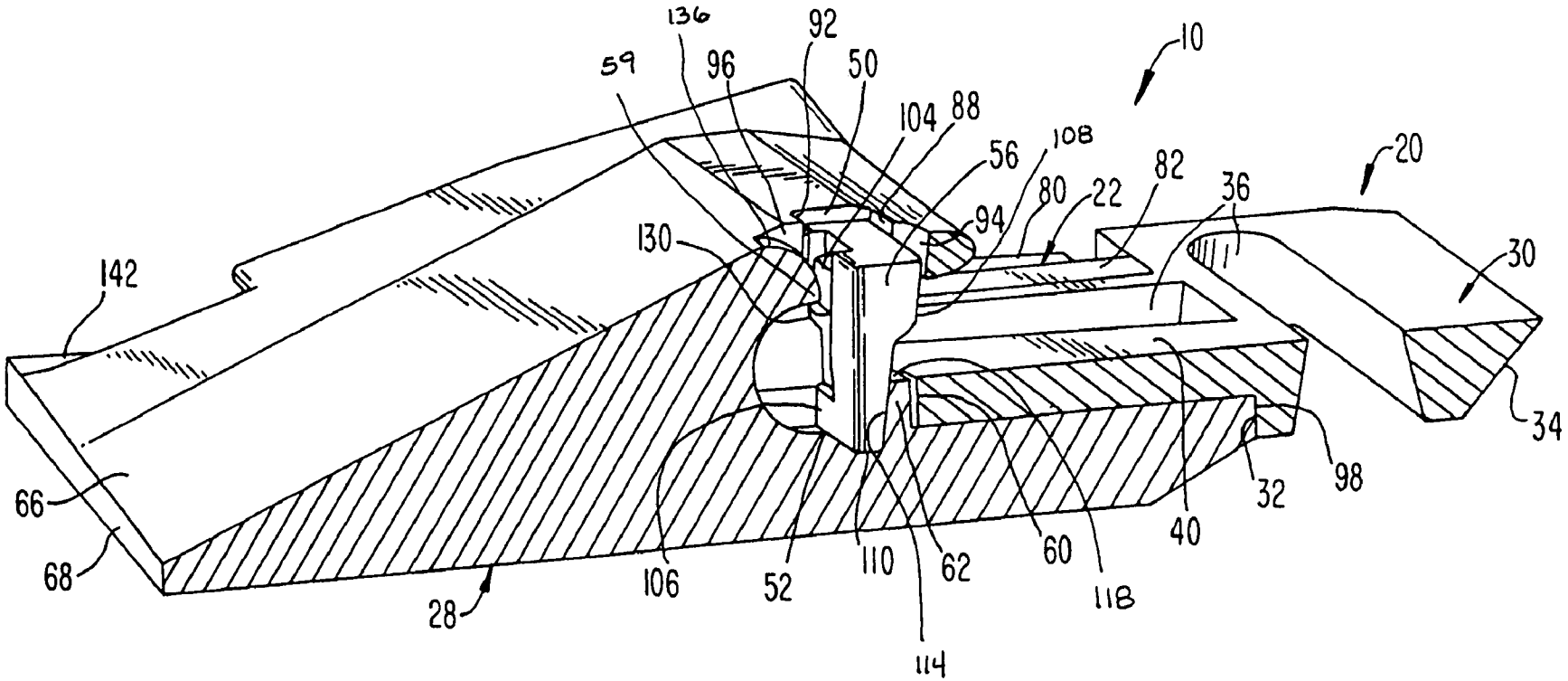
FIG. 16 is a cross-sectional view taken along line XVI-XVI in FIG. 1.
Figure 17:
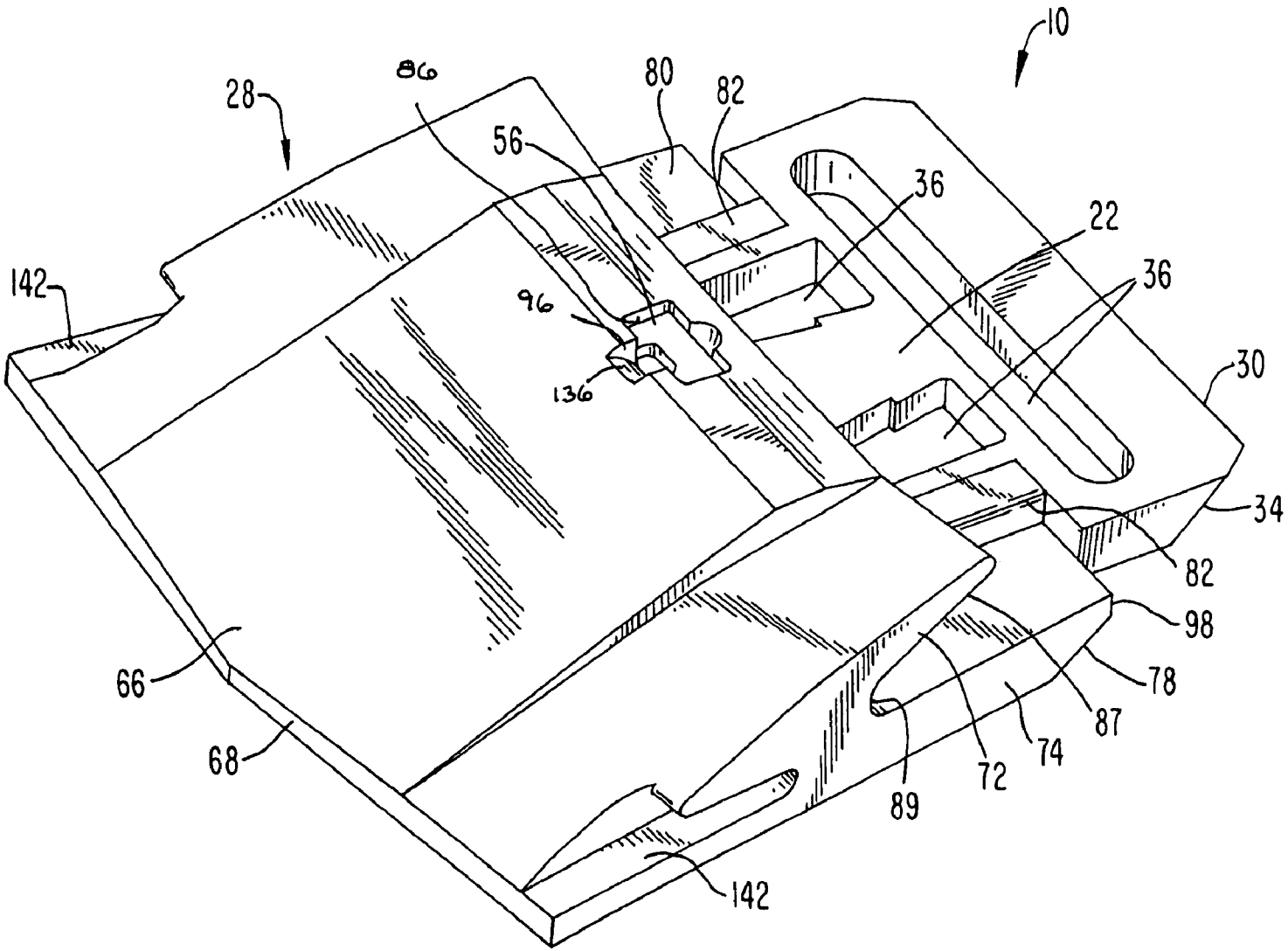
FIG. 17 is a top, front perspective view of the wear assembly with the lip omitted.
Figure 18:
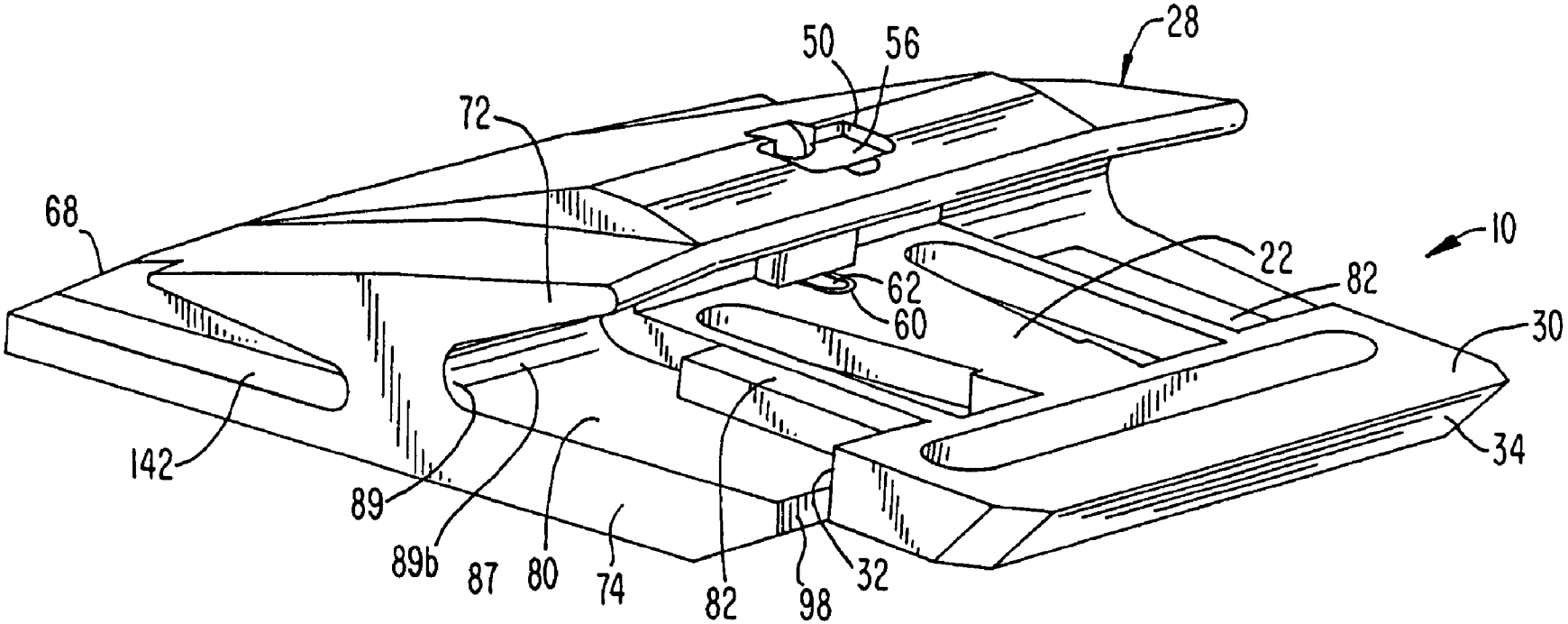
FIG. 18 is a rear perspective view of the wear assembly with the lip omitteduse.

Shroud 28 includes an inner surface 85 that includes inner face 80 of outer leg 74, inner face 87 of inner leg 72, and the inner corner surface 89 at the intersection of legs 72, 74 (FIGS. 13-16 and 18). Inner corner surface 89 has a central section 89*a* that generally matches front face 48 of boss 20 and abuts against it. Accordingly, in the preferred embodiment, inner corner surface 89 has a generally uniform curved surface. When assembled, inner face 80 of outer leg 74 overlies body 22 and outer face 14*b*, 16*b*, and inner face 87 of inner leg 72 overlies finger portion 39 and inner face 14*a*, 16*a* (FIGS. 16-18). Inside corner surface 89 also includes side sections 89*b* that have a slightly narrower radius of curvature than central section 89*a* to define side faces 91 that set just outside side surfaces 93 of front part 38 (FIGS. 3, 4 and 15). The juxtaposition of side faces 91 and side surfaces 93 will provide additional lateral support for shroud 28 at the front edge of lip 12. Although all of the bosses 20 are preferably identical, a unique boss could be formed for the center of central section 14 of lip 12 where a peak 100 is formed. In this construction, the inner surface of the boss that wraps around the front edge of the lip would be formed with slight angle to match the formation of the lip. Inner leg 72 includes an aperture 86 adapted to receive lock 56 therein. As a result, aperture 86 is generally aligned with recess 50, hole 52 and one of the scallops 18. In the preferred embodiment, aperture 86 has a generally rectangular configuration (to match the preferred lock) with the rear wall 88 forming bearing faces to abut the lock. As described below, rear wall 88 and front wall 92 each include a central groove 94, 96 (FIG. 13). Groove 94 is formed to provide clearance for the movement of an elastomer in the lock. Groove 96 is provided to permit the insertion of a pry tool for removing the lock. The rear and front walls 88, 92 of aperture 86 preferably converge toward each other as they extend toward boss 20 to receive a tapered lock that can be pried into and out of the assembly. A rib 62 projects upward from inner face 80 to abut the lower end of lock 56.

Figure 1:
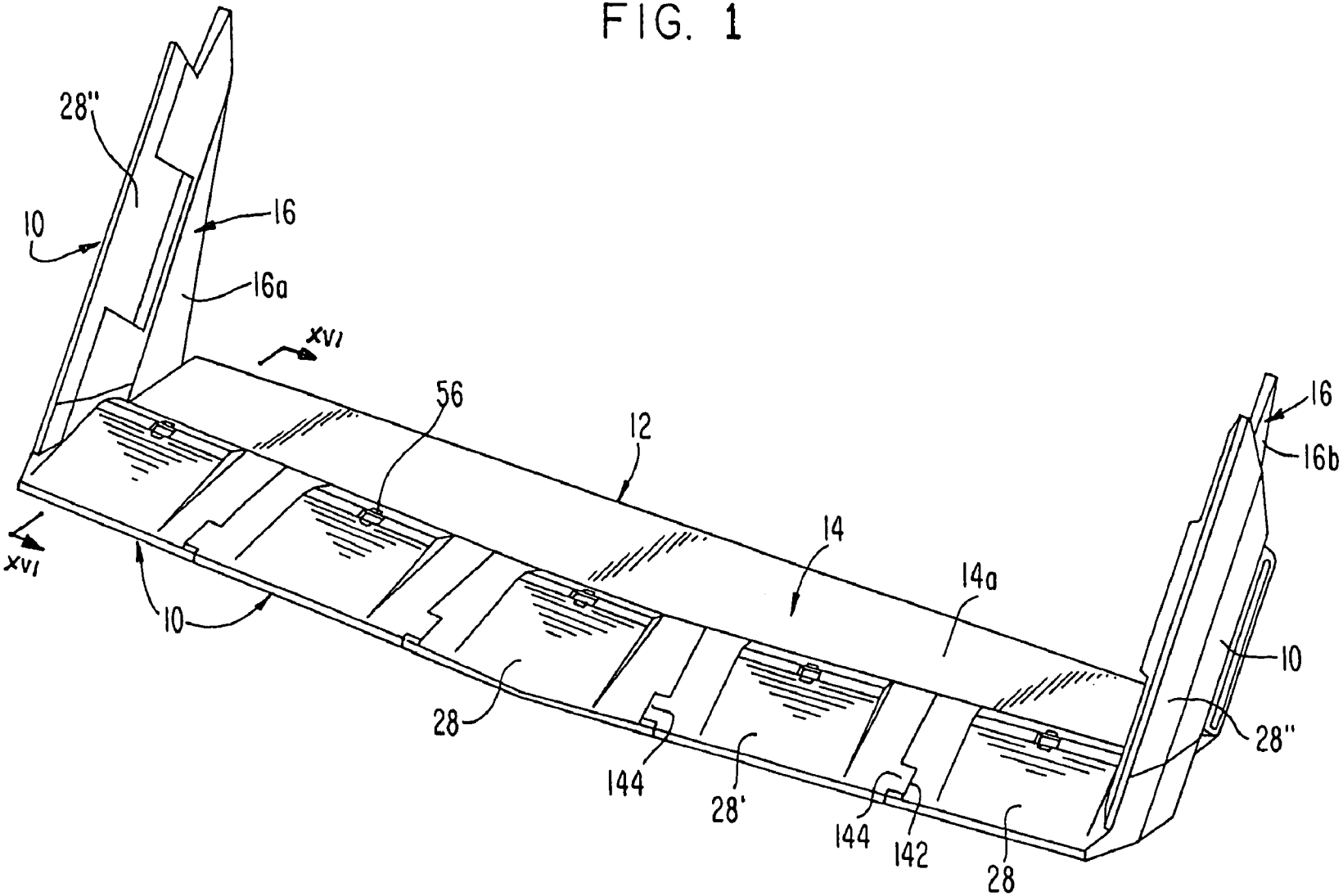
FIG. 1 is a perspective view of a lip of an excavating bucket provided with wear assemblies in accordance with the present invention.

When shroud 28 is installed, it is slid over lip 12 such that inner and outer legs 72, 74 straddle the lip (FIG. 1). Rails 24 of body 22 are fit within slot 84 as shroud 28 is moved rearward (FIG. 18). The rearward movement is continued until inside corner surface 89 abuts front face 48 of boss 20 (FIGS. 16-18). At this juncture, rear wall 98 of outer leg 74 is preferably placed in close proximity to stop surface 32. With cast parts, it is not practical for inside corner surface 89 and rear wall 98 to simultaneously abut front face 48 and stop surface 32, respectively. However, by placing rear wall 98 in close proximity with stop surface 32, the two surfaces will typically abut after a short amount of time as wear develops in the parts. While it is not preferred, stop surface 32 could be the primary bearing surface that first abuts rear wall 98, with inside corner surface 89 abutting front face 48 after some wear. Also, as shroud 28 is installed, rib 62 passes through groove 64 in front part 38 of boss 20, through main portion 58 of hole 52, and into pocket 60.

Figure 19:
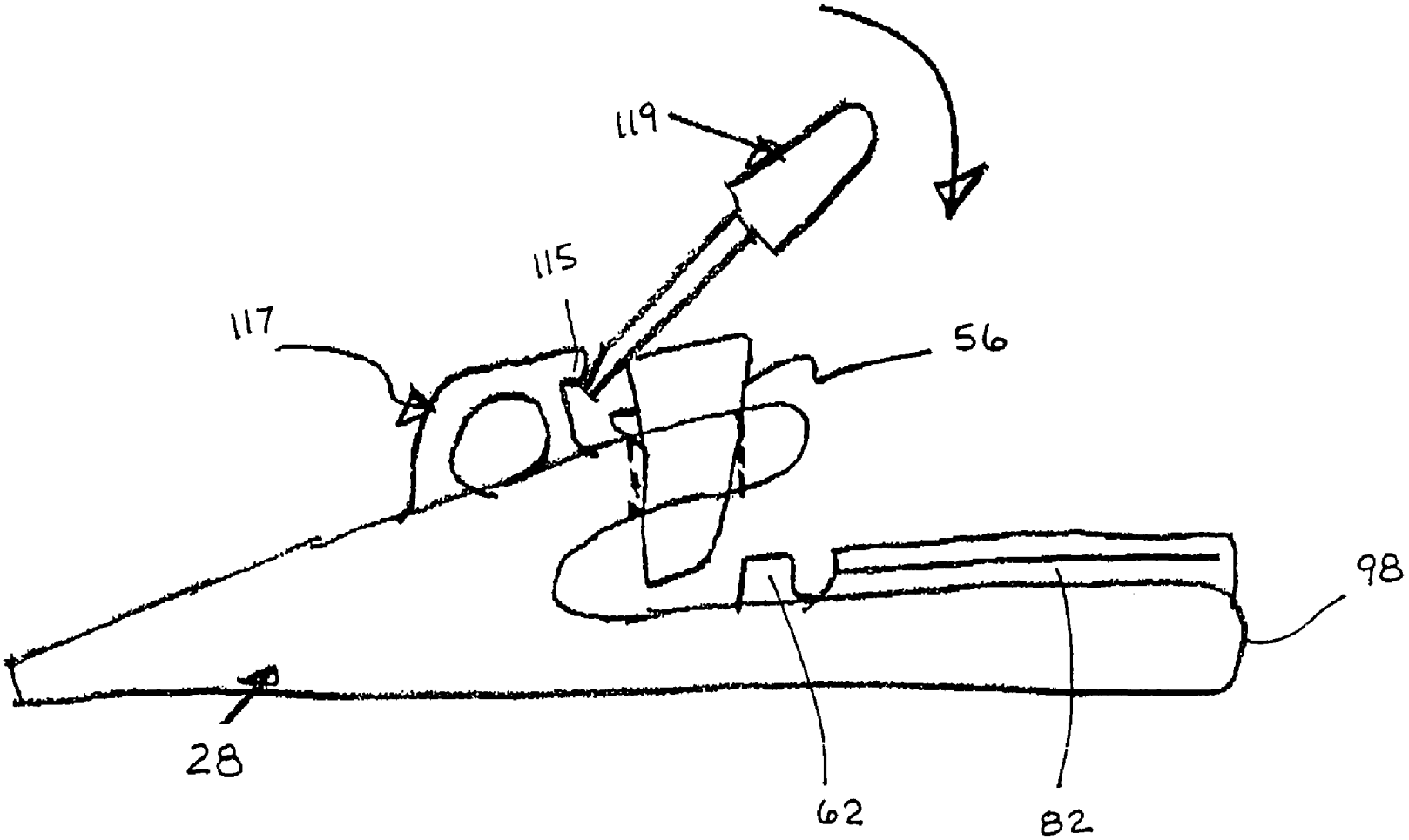
FIG. 19 is a side view of the wear member provided with a lifting eye.

Once shroud 28 is fully pushed onto boss 20, lock 56 is inserted into aperture 86, recess 50, hole 52 and one of the scallops 18 (FIGS. 16-18). As seen in FIGS. 9-12, lock 56 preferably has a rigid body 102, a latch 104 and an elastomeric member (not shown). In the preferred construction, body 102 has a gradually tapering shape with front and rear walls 106, 108 that converge as they extend toward leading face 110. Rear wall 108 is divided by a step 112 into an upper or inner section 108*a* and a lower or outer section 108*b*. Preferably the inner and outer sections 108*a*, 108*b* are generally parallel to each other, although they could have differing orientations. Inner section 108*a* is adapted to set against rear wall 88 in aperture 86, and outer section 108*b* against the front face 114 of rib 62. Accordingly, rear wall 88 and front face 114 are preferably inclined to match the inclination of rear wall 108. As disclosed in U.S. patent application Ser. No. 10/187,446 filed Jul. 2, 2002, entitled "Coupling for Excavating Wear Part," which is hereby incorporated by reference in its entirety, this mating relationship of a tapered lock with the opening into which it is received eases the insertion and removal of the lock; that is, since the lock walls do not fully engage the opening walls until the lock is fully set in the assembly, the necessity for using a large hammer to insert the lock is obviated. Rather, in certain environments, it is possible to manually insert the lock into the assembly without tools. Alternatively, a pry tool may be used. In the example illustrated in FIG. 19, a prying ledge 115 is provided on a lifting eye 117. A pry tool 119 can engage prying ledge 115 to push lock 56 into the assembly. Of course, other prying arrangements are possible, and a hammer could be used if desired. Similarly, since the lock will release from the opening walls immediately after being moved in the release direction, the lock can be pried out of the assembly.

Figure 11:
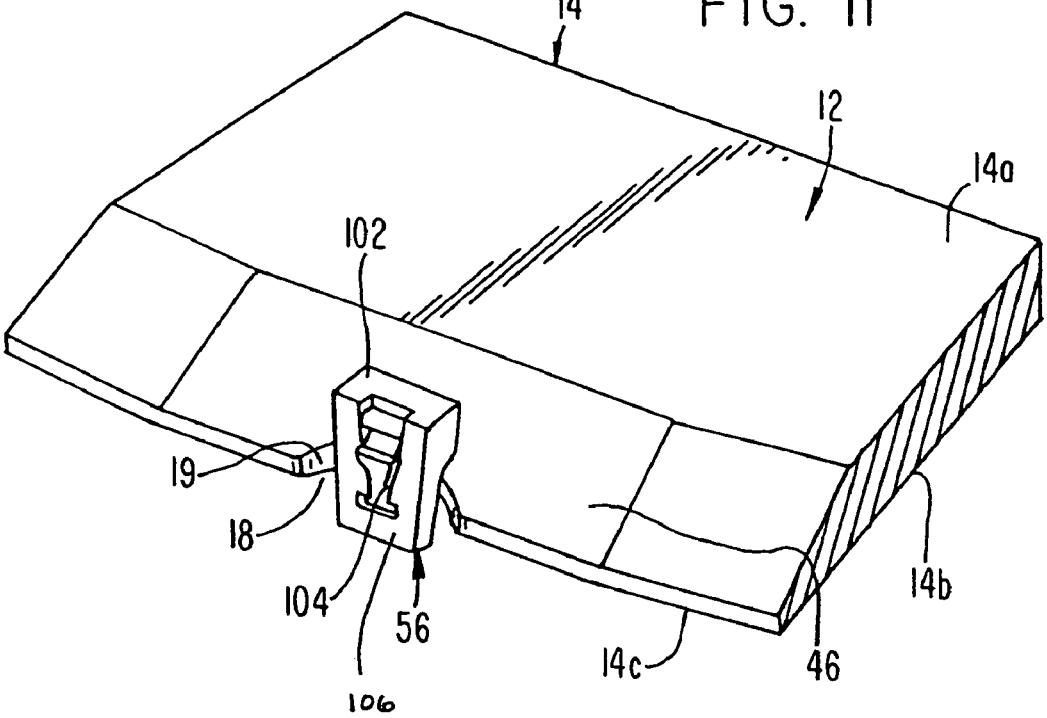
FIG. 11 is a perspective view of the lock and its relation to the lip during use.
Figure 12:
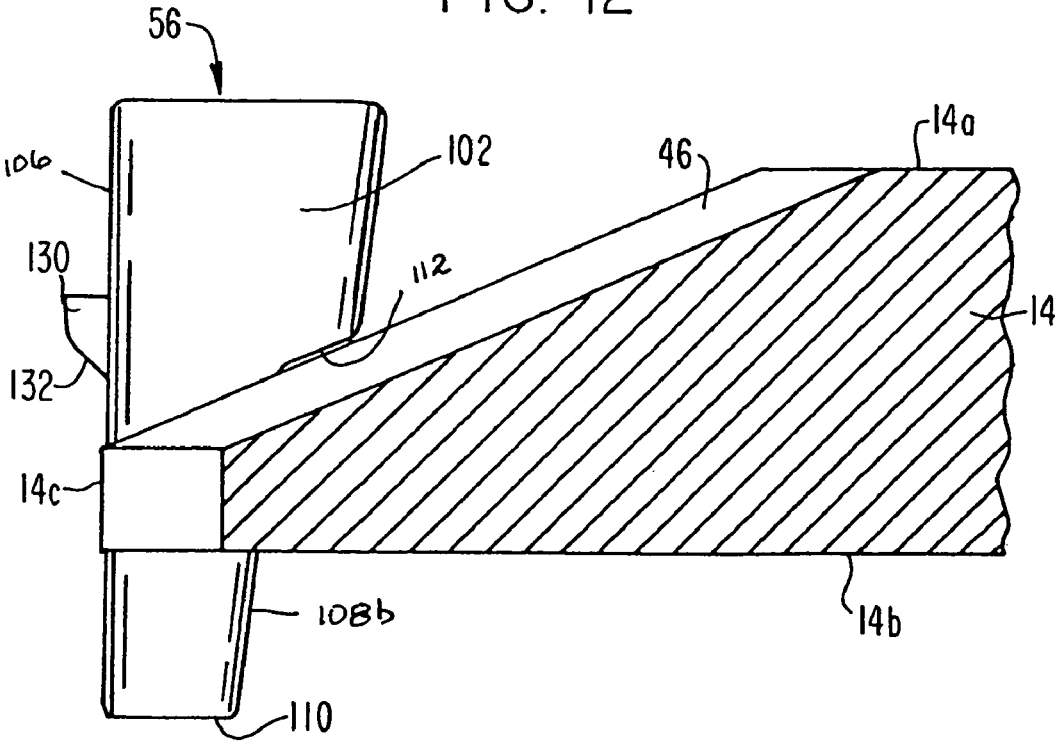
FIG. 12 is a side view of the lock and its relation to the lip during use.

The use of step 112 permits a larger, more robust portion of the lock to be fit within aperture 86 and to include a cavity 116 to contain the elastomeric material (not shown). The narrower portion below step 112 permits the use of a scallop 18 having minimal depth. When assembled, scallop wall 19 is juxtaposed to outer section 108*b* just below step 112 (FIGS. 11-12). Rib 62 sets just below lip 12 so that the inner or top surface 118 is juxtaposed to outer surface 14*b*, 16*b* of lip 12 (FIG. 16). Step 112 generally parallels ramp 46 in a spaced relation (FIGS. 11-12). Front wall 106 abuts against main wall 57 in recess 50 of boss 20 and front wall 120 of hole 52 (FIGS. 3 and 17-19). As can be appreciated, the lock, along both front wall 106 and rear wall 108 abuts shroud 28 and boss 20 inside and outside of lip 12 (i.e., to each side of a central plane of the main member 14 or corner member 16 between inner face 14*a*, 16*a* and outer face 14*b*, 16*b*) for a more stable and balanced locking arrangement than the prior art assemblies.

Figure 9:
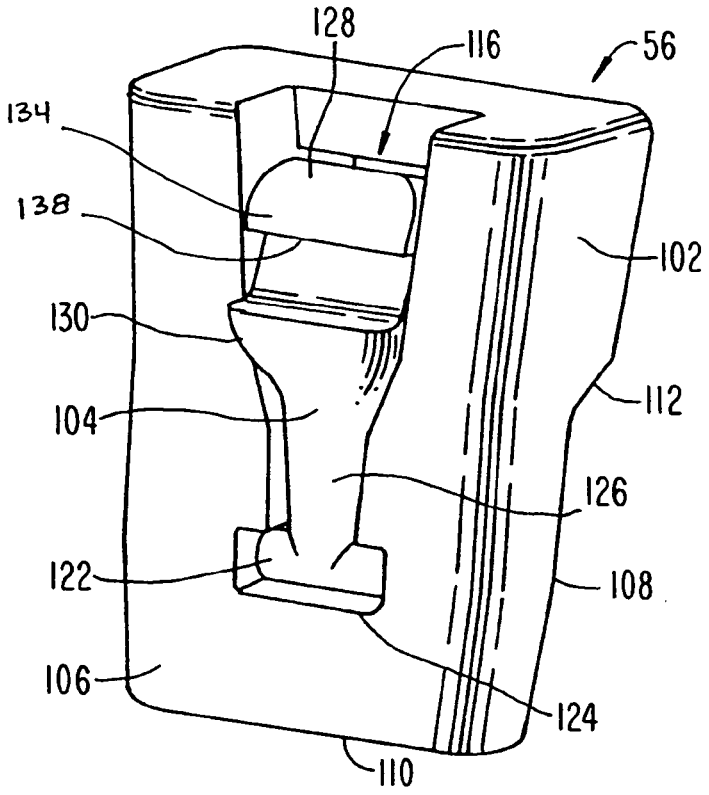
FIG. 9 is a perspective view of a lock in accordance with the present invention with the elastomer omitted.
Figure 10:
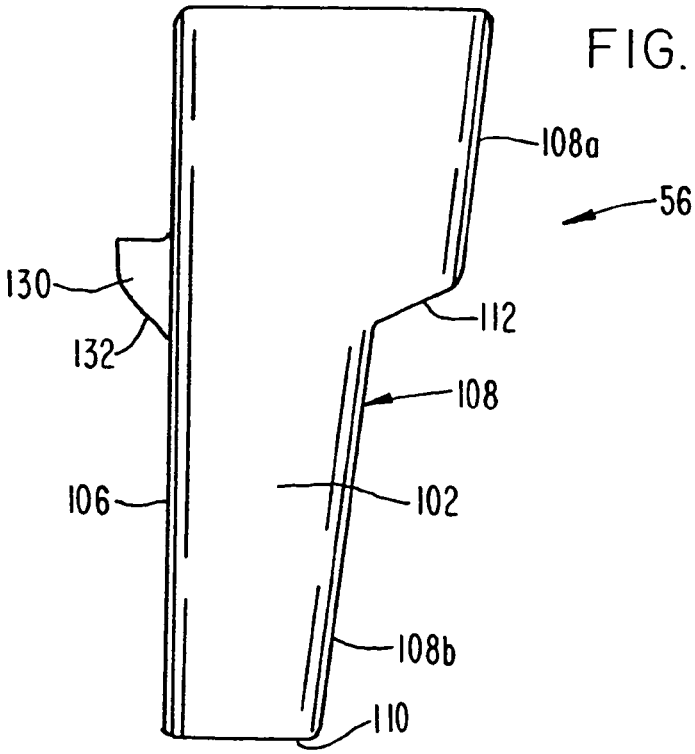
FIG. 10 is a side view of the lock.

Latch 104 is preferably pivotally mounted within cavity 116 of body 102 (FIGS. 9-10). In particular, latch 104 includes a pivot pin 122 that fits within a lateral recess 124, a stem 126, and a head 128. Head 128 includes a shoulder 130 that projects outward beyond front wall 106 to fit under keeper ledge 59 to retain lock 56 in the wear assembly. An elastomeric material (not shown), such as rubber, is fit within cavity 116 behind latch 104. The elastomer normally biases latch 104 outward in a locked position, as shown in FIG. 10. The leading or lower surface 132 of shoulder 130 has a curved configuration to guide the latch rearward as it strikes against shroud 28 as it is inserted into aperture 86 so that shoulder 130 is pushed within cavity 116. When the lock is fully inserted into the assembly, the elastomer biases the latch outward so that shoulder 130 fits under keeper ledge 59. In the preferred construction, the elastomer is affixed to the rear wall of latch 104 and within cavity 116 by adhesive or molding. Alternatively, the elastomer could be held within cavity by friction and/or mechanical means.

To facilitate removal of lock 56, shroud 28 includes groove 96 to permit the insertion of a tool (not shown) to push the latch rearward against the bias of the elastomer (FIGS. 9, 13, 16 and 17); that is, the tool presses against the front face 134 of head 128 with leverage against the front wall 136 of groove 96. Front wall 136 is curved inward to better guide latch 104 rearward, and provide a better leverage surface for the tool. Head 128 preferably also includes a pry surface 138 under front face 134, whereby the tool pushing the latch rearward can be further rotated against front wall 136 to pry the lock from the assembly (FIGS. 9 and 10); that is, the free end of the tool engages pry surface 138 so that as the tool continues to rotate it applies an upward force on the latch. The pivot pin 122 being received within recess 124 provides the needed resistance to permit such prying on the latch. In general, a pry tool (not shown) can be fit into groove 96 with a pry surface (not shown) to pull the lock from the assembly.

Shrouds 28 are preferably formed of two different constructions along their sides. As seen in FIGS. 1 and 13-16, one kind of shroud 28 includes grooves 142 which receive tongues 144 from the other kind of shroud 28' (FIG. 1). In this way, the shrouds mate together, with the tongues 144 in grooves 142 to provide a more integral assembly and better cover front edge 14*c* of lip 12. A third kind of shroud 28" can be formed without grooves 142 or tongues 144 for attachment to corner sections 16. Nevertheless, a shroud of a single shape of can be used if desired. For instance, each shroud can be formed with a groove on side and a tongue on the other, or each could be formed without either a groove or tongue.

The invention claimed is:

1. A lip of an excavating bucket having an interior scoop structure and an exterior surface, the lip comprising:

a base member having an inner face adapted to form a part of the interior scoop structure of the bucket, an outer face adapted to form a part of the exterior of the bucket, and a front edge face extending across the front of the base member and interconnecting the inner and outer faces, the front edge face including a recess; and a boss fixed to the base member and including a front part extending generally along the front edge face, and a body extending rearwardly from the front part along one of the inner and outer faces of the base member, the boss defining a hole forward of the front edge face and in general alignment with the recess to receive a lock through the hole and the recess to secure a wear member to the lip, and the boss including a longitudinal coupling structure that slidably connects with a complementary coupling structure of a wear member to mount the wear member to the lip.

2. The lip in accordance with claim 1 in which the recess is defined by a concave wall having a length extending no more than about 180 degrees generally around an axis of the recess and extending generally perpendicular to the base member.

3. The lip in accordance with claim 2 wherein the concave wall of said recess has a generally continuous, uniform curvature.

4. The lip in accordance with claim 1 wherein the boss includes a generally rearward facing bearing surface in the hole to abut a lock holding the wear member to the lip.

5. The lip in accordance with claim 1 in which the base member includes a main member that extends across the expanse of the interior scoop structure and a corner member at each end of a main member, wherein each said corner member extends generally transverse to the main member, and wherein the main member and each said corner member includes a part of the front edge face that has at least one of the recesses and one of said bosses.

6. The lip in accordance with claim 1 wherein the longitudinal coupling structure is one part of a tongue and groove coupling structure.

7. A wear member for attachment to a lip of an excavating bucket, wherein the lip has a front edge, the wear member comprising a front working portion and a rear mounting portion, the rear mounting portion including a pair of legs that straddle the lip, one of the legs including one part of a tongue and groove coupling structure having a front end and a rear end, the coupling structure being adapted to slide rearwardly over the lip to engage a complementary formation on a base fixed the lip, each said leg including a bearing surface, said bearing surfaces facing in a forward direction and being generally aligned to engage a look to hold the wear member to the lip, and one said bearing surface being proximate the front end of the coupling structure.

8. The wear member in accordance with claim 7 wherein the coupling structure includes a pair of opposite rails.

9. The wear member in accordance with claim 8 wherein the rails and the respective leg collectively define a generally T-shaped configuration.

10. The wear member in accordance with claim 7 wherein the leg opposite the leg with the coupling structure includes an opening through which the lock is received.

11. The wear member in accordance with claim 10 wherein a rear wall of the opening defines one of the bearing surfaces.

12. The wear member in accordance with claim 11 wherein the leg with the coupling structure includes a rib extending generally toward the opening, and a front wall of the rib defines the other of the bearing surfaces.

13. A wear member for mounting on a digging edge of excavating equipment comprising:

a front working portion;

a rear mounting portion including a pair of rearwardly extending legs to straddle the digging edge, each of the legs having an inner surface facing the other leg, and a corner surface interconnecting the inner surfaces of the legs;

one part of a tongue and groove coupling structure formed along the inner surface of only a first one of the legs to couple to a complementary part of a tongue and groove coupling structure formed on a boss fixed to the digging edge;

an opening in a second one of the legs for receiving a lock, the opening having a forward facing bearing surface to contact the lock and hold the wear member to the digging edge; and a cavity formed in the corner surface to receive a portion of the boss, the cavity having a pair of opposing sidewalls extending transverse to the inner surfaces to engage side surfaces of the boss for lateral support of the wear member.

14. The wear member in accordance with claim 13 which is a shroud wherein the working portion is a wearable tip that tapers to a free end.

15. The wear member in accordance with claim 13, wherein the corner surface has a generally uniform curved surface to abut a correspondingly curved front part of the boss fixed to the digging edge.

16. The wear member in accordance with claim 13 including a rear deflector face at a rear end that is inclined forwardly away from the lip to direct earthen material away from the wear member during reverse movement of the excavating equipment.

* * * * *

UNITED STATES PATENT AND TRADEMARK OFFICE

CERTIFICATE OF CORRECTION

PATENT NO. : 7,451,558 B2
APPLICATION NO. : 11/216697
DATED : November 1, 2008
INVENTOR(S) : Larren F. Jones It is certified that error appears in the above-identified patent and that said Letters Patent is hereby corrected as shown below:

In Column 8, line 55, "look" should be changed to --lock--.

Signed and Sealed this

Tenth Day of November, 2009

David J. Kappos

David J. Kappos
*Director of the United States Patent and Trademark Office*